US009779923B2

(12) United States Patent
Verenchikov

(10) Patent No.: US 9,779,923 B2
(45) Date of Patent: Oct. 3, 2017

(54) METHOD AND SYSTEM FOR TANDEM MASS SPECTROMETRY

(71) Applicant: LECO Corporation, St. Joseph, MI (US)

(72) Inventor: Anatoly N. Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 14/776,644

(22) PCT Filed: Mar. 14, 2014

(86) PCT No.: PCT/US2014/028173

§ 371 (c)(1),
(2) Date: Sep. 14, 2015

(87) PCT Pub. No.: WO2014/152902

PCT Pub. Date: Sep. 25, 2014

(65) Prior Publication Data

US 2016/0035552 A1 Feb. 4, 2016

Related U.S. Application Data

(60) Provisional application No. 61/783,203, filed on Mar. 14, 2013.

(51) Int. Cl.
*H01J 49/40* (2006.01)
*H01J 49/00* (2006.01)

(52) U.S. Cl.
CPC ..... *H01J 49/0045* (2013.01); *H01J 49/0031* (2013.01); *H01J 49/406* (2013.01)

(58) Field of Classification Search
CPC .. H01J 49/004; H01J 49/0031; H01J 49/0036; H01J 49/40; H01J 49/0045; H01J 49/406
See application file for complete search history.

(56) References Cited

U.S. PATENT DOCUMENTS 7,141,784 B2 * 11/2006 Vachet ..... G01N 33/6848 250/281
9,190,255 B2 * 11/2015 Raptakis ..... H01J 49/067
(Continued)

FOREIGN PATENT DOCUMENTS

CN 1689134 A 10/2005
JP 2005538346 A 12/2005
(Continued)

OTHER PUBLICATIONS

International Search Report dated Sep. 30, 2014, relating to International Application No. PCT/US2014/028173.
(Continued)

*Primary Examiner* — Wyatt Stoffa

(57) ABSTRACT

A method of data independent MS-MS analysis is disclosed. The method comprises ramping or stepping in small steps of a wide (at least 10 amu) parent mass window in a first parent selecting mass spectrometer (MS1), arranging rapid ion transfer through a collisional cell, either by axial gas flow or by an axial DC field or by a travelling RF wave, frequently pulsing an orthogonal accelerator with a string of time-encoded pulses, analyzing fragment ions in a multi-reflecting time-flight mass spectrometer, acquiring data in a data logging format, and decoding signal strings corresponding to the entire scan of parent masses, such that fragment spectra are formed based on time correlation between fragment and parent masses. Frequent pulsing is expected to recover parent and fragment time correlation with an accuracy of approximately 1 Th, in spite of using much wider mass window in the first MS.

12 Claims, 4 Drawing Sheets

(56) References Cited

U.S. PATENT DOCUMENTS

2003/0168589 A1* 9/2003 Hager ..... H01J 49/4225 250/282
2005/0242279 A1* 11/2005 Verentchikov ..... H01J 49/40 250/287
2007/0023638 A1* 2/2007 Bateman ..... H01J 49/4225 250/287
2009/0101810 A1* 4/2009 McLean ..... B82Y 30/00 250/282
2011/0084205 A1* 4/2011 Makarov ..... H01J 49/0045 250/282
2012/0261568 A1 10/2012 Coon
2013/0048852 A1* 2/2013 Verenchikov ..... H01J 49/0031 250/282
2013/0056627 A1* 3/2013 Verenchikov ..... H01J 49/406 250/282
2013/0206979 A1* 8/2013 Bonner ..... H01J 49/0031 250/282
2013/0240723 A1* 9/2013 Bonner ..... H01J 49/0045 250/282
2014/0284472 A1* 9/2014 Verenchikov ..... G01N 27/622 250/282
2014/0346341 A1* 11/2014 Giles ..... H01J 49/0045 250/282
2015/0115151 A1* 4/2015 Verenchikov ..... G01N 27/622 250/283
2015/0228469 A1* 8/2015 Mizutani ..... H01J 49/4215 250/292

FOREIGN PATENT DOCUMENTS

JP 2007526596 A 9/2007
RU WO 2011135477 A1 * 11/2011 ..... H01L 49/0031
WO WO 2012/035412 3/2012

OTHER PUBLICATIONS

Chinese Office Action for the related Application No. 201480013910.1 dated Jun. 7, 2016.
Marshall Bern, et al., Deconvolution of Mixture Spectra , Feb. 1, 2010, pp. 833-841.
Japanese Office action with its English translation for the related application No. 2015-560412 dated Jul. 25, 2015.

* cited by examiner

METHOD AND SYSTEM FOR TANDEM MASS SPECTROMETRY

SUMMARY

Tandem mass spectrometry (MS-MS) can be used for multiple compound identification within complex mixtures. In such uses, a mixture of analytes is ionized, one parent ion specie is selected in a time within a first mass spectrometer (MS1), subjected to fragmentation, usually in collisional induced dissociation (CID) cell, and mass spectra of fragment ions are recorded within the second stage mass spectrometer (MS2). Because the combination of parent and fragment ion masses m1-m2 is compound specific, the MS-MS analysis allows detecting ultra traces within reach chemical matrices. Triple quadrupoles MS-MS (where CID cell is considered as a second quadrupole) are widely employed for drug metabolite studies, while monitoring selected and preliminary defined combinations of m1-m2. Lately MS-MS instruments, employing quadrupole for MS1 and time-of-flight (TOF) for MS2, became useful for characterization of complex mixtures like proteome mixtures. In such analyses, in an attempt to cover a maximal number of analyte compounds, the quadrupole selector can be either scanned through the entire mass range (usually up to 1000 amu for systems using Electrospray—ESI sources), while TOF is often used for acquiring panoramic spectra.

When analyzing complex mixtures, like a collection of up to one million different peptides from cell lysates, Q-TOF tandems are combined with liquid chromatography (LC). The chromatography can dramatically reduce momentarily sample complexity, but still, hundreds and thousands of compounds coelute simultaneously. In an MS-MS instrument, the underlying analysis is performed in a limited time span, usually full mass range analysis is performed within 1-3 seconds.

LC-Q-TOF acquisition methods are designed to follow two general strategies. In one strategy, called data dependent acquisition (DDA), a list of major parent peaks is formed when analyzing the mixture without fragmentation. Then MS1 stage is stepped between parent masses, and the fragmentation is turned on (by adjusting ion energy at the entrance of the CID cell) to form a set of fragment spectra. This analysis can be generally limited by the ability to observe parent ions in MS1 spectrum (which is obscured for minor compounds by rich chemical matrix), by the number of the followed channels, and by a relatively small dynamic range as there is simply no time to acquire spectra for all parent ions.

In another—data independent strategy, the MS1 may be stepped through the whole mass range, while acquiring fragment spectra for each of parent mass m1, but for a very limited dwell time. For example, and without limitation, at or about one second scan time, at or about 1000 amu mass span and at or about 3 amu MS1 window (usually designed to observe an isotopic cluster), there is at or around 3 ms dwell time for acquiring MS-MS spectra for the individual mass window. A combination of short dwell time and low duty cycle of conventional TOF MS with orthogonal accelerator do limit the dynamic range of analyzed compounds. Such exemplary system generally requires rapid ion transfer through the CID cell (which causes approximately at or about 1 ms time lost for parent switching), and requires generally rapidly controlled and synchronized power electronics and data acquisition system.

Thus, for the analysis of complex mixtures, the prior art Q-TOF tandems can provide either limited number of identifications, or in a limited dynamic range. In an embodiment, invention extends the dynamic range of analyzed compounds without limiting the list of parent masses and in a data independent and, thus, robust acquisition fashion.

A method of data independent MS-MS analysis is disclosed. The method comprises ramping or stepping in small steps of a wide (at least 10 amu) parent mass window in a first parent selecting mass spectrometer (MS1), arranging rapid ion transfer through a collisional cell, either by axial gas flow or by an axial DC field or by a travelling RF wave, frequently pulsing an orthogonal accelerator with a string of time-encoded pulses, analyzing fragment ions in a multi-reflecting time-flight mass spectrometer, acquiring data in a data logging format, and decoding signal strings corresponding to the entire scan of parent masses, such that fragment spectra are formed based on time correlation between fragment and parent masses.

BRIEF DESCRIPTION OF THE DRAWINGS

The accompanying drawings illustrate various embodiments of the present system and method and are a part of the specification. The illustrated embodiments are merely examples of the present apparatus and method and do not limit the scope of the disclosure.

The details of one or more implementations of the disclosure are set forth in the accompanying drawings and the description below. Other aspects, features, and advantages will be apparent from the description and drawings, and from the claims.

DETAILED DESCRIPTION

The following description of the various embodiments is merely exemplary in nature and is in no way indented to limit the invention, its application or uses. Based on the foregoing, it is to be generally understood that the nomenclature used herein is simply for convenience and the terms used to describe the invention should be given the broadest meaning by one of ordinary skill in the art.

Although the specific system and method examples are discussed, the described principles described have applicability in many respects to other suitable environments.

In an implementation, the dynamic range of data independent MS-MS analysis can be improved by substantially continuously ramping (or stepping in small steps) of a wide (at least 10 amu) parent mass window in a first parent selecting mass spectrometer (MS1) while arranging rapid ion transfer through a collisional cell, frequently pulsing an orthogonal accelerator with a string of time-encoded pulses, analyzing fragment ions in a multi-reflecting time-flight mass spectrometer, acquiring data in a data logging format, and decoding signal strings corresponding to the entire scan of parent masses.

Figure 1:
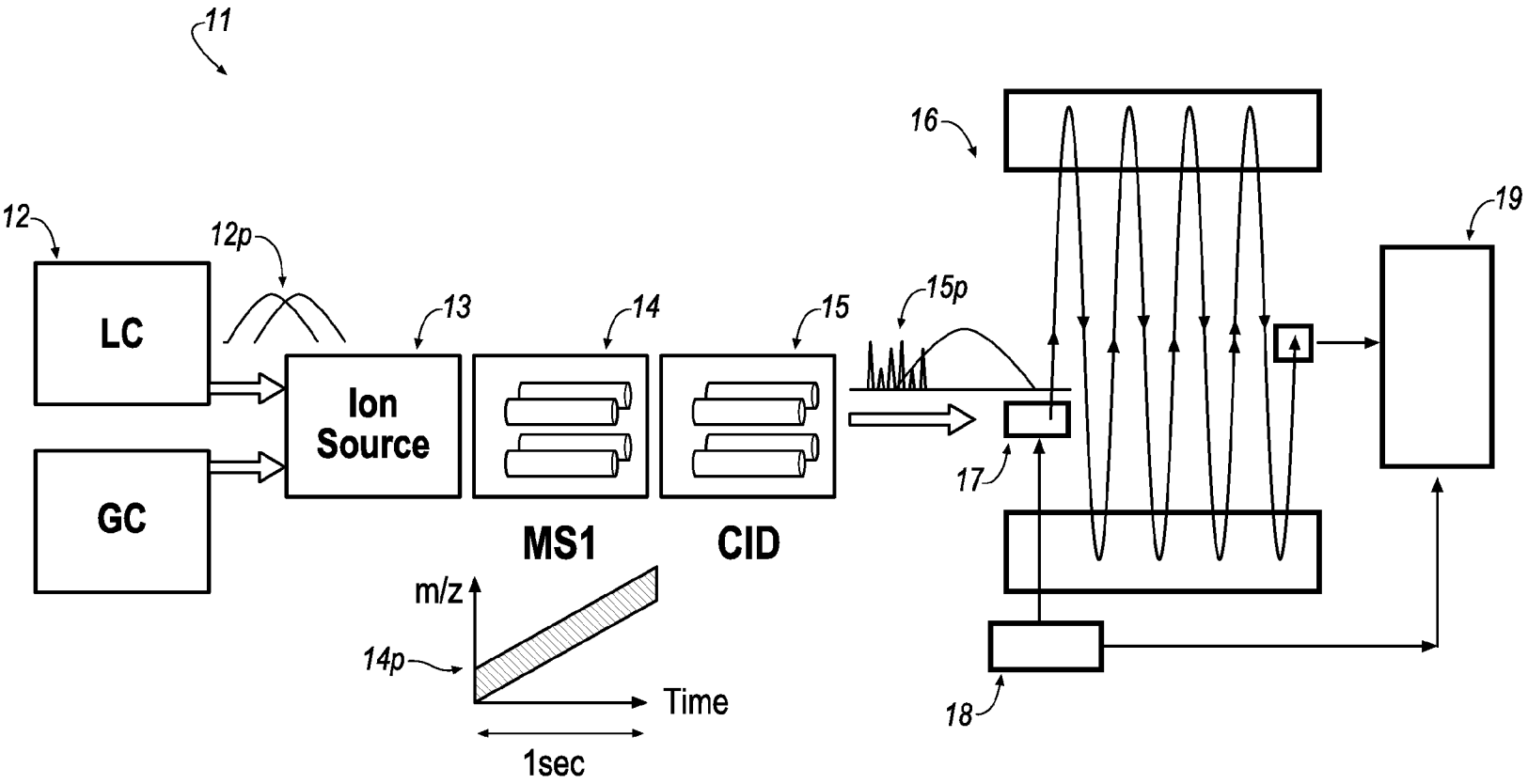
FIG. 1 illustrates an exemplary spectrometry apparatus, according to an implementation.

Referring to FIG. 1, an exemplary apparatus 11 comprises an upfront chromatograph 12 (either LC or GC), an ion source 13 for ionizing sample, an analytical quadrupole analyzer 14, a CID cell 15, a multi-reflecting analyzer 16, with an orthogonal accelerator 17, being driven by a generator 18 with frequent encoded pulses, and a decoding data system 19 fed by ion signal and obtaining an information of triggering pulse timing. The output profiles 12*p* of the chromatograph 12 are expected to be substantially at or between 5-10 seconds wide in case of LC, and substantially at or about 1 second wide in case of GC. In an implementation, the quadrupole mass spectrometer 14 is ramped at approximately 1000 Th/s speed to momentarily transmit a relatively wide (substantially at or between 10-20 Th) mass window for selecting parent ions, as shown in diagram 14*p*. In an implementation, parent ions may be injected substantially at or between 20-50 eV energy into a collisional cell to induce fragmentation. As a result, at the output of the CID cell 15 there will appear families of parent and fragment ions correlated at approximately 1 ms time scale. Exemplary families are depicted by profiles 15*p*, where sharp peaks generally correspond to an individual family and wider curves generally depict a much slower modulating profile of the chromatographic peak. In an implementation, the entire ion beam is substantially continuously fed into the orthogonal accelerator 17. In an implementation, the accelerator 17 is pulsed at an average rate of substantially at or about 100 kHz in an encoded fashion, wherein the majority of pulse intervals are unique, such that the overlaid spectra could be decoded in the decoder 19.

Figure 2:
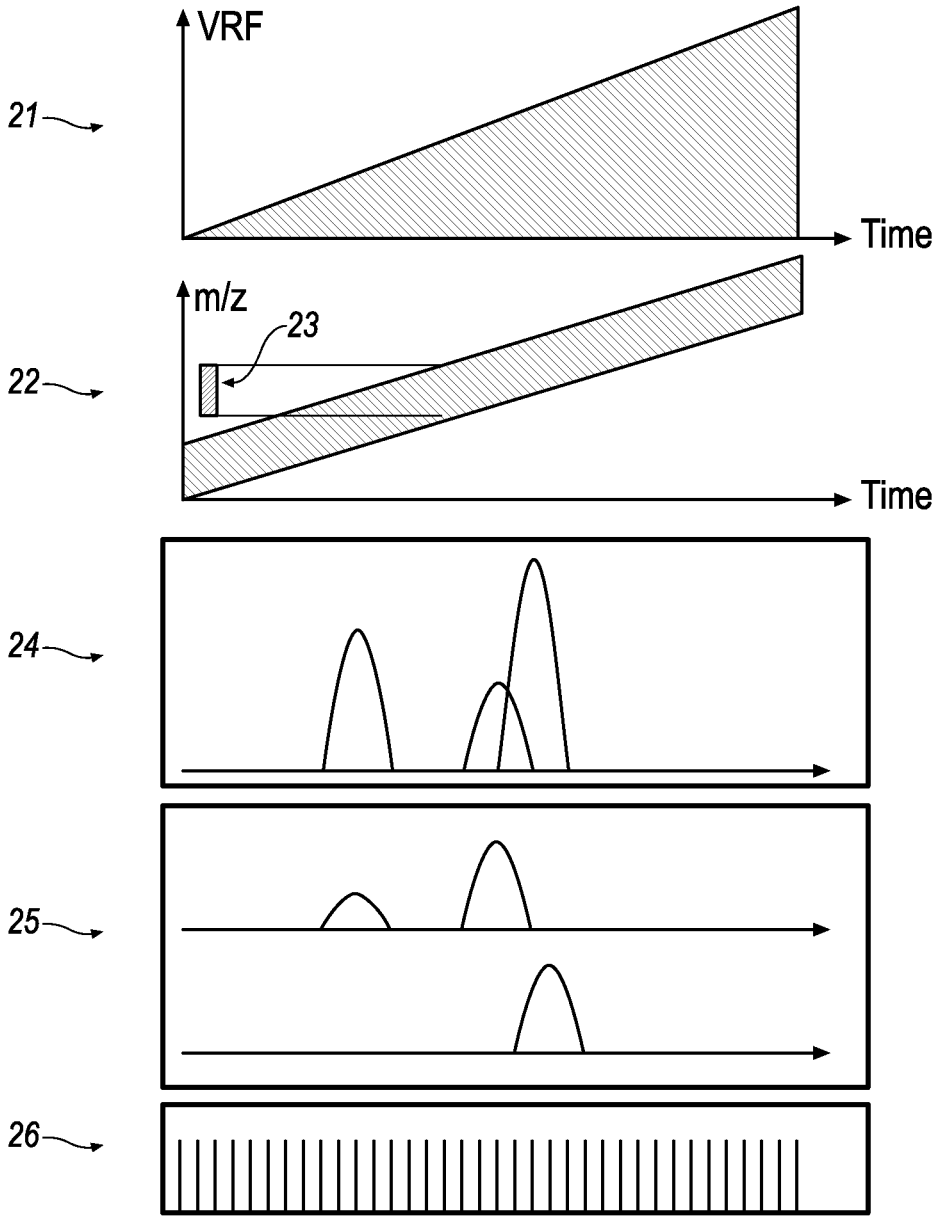
FIG. 2 illustrates an implementation of a strategy of a ramped data independent analysis.

With reference now to FIG. 2, an implementation of a strategy of a ramped data independent analysis is illustrated. The upper graph 21 represents a linear ramp of the RF amplitude. In an implementation, the DC voltage of the MS1 analytical quadrupole is linked scanned. But compared to high resolution scan (e.g., R=M) one may employ either (i) a somewhat smaller ratio between RF and DC, or (ii) an offset DC voltage to transmit Th mass window that is generally wider than one. In an implementation, the offset or a ratio determines the mass width of the window 23, which is expected to be used anywhere from substantially at or between 1 to 100 amu, and more preferably substantially at or between 10 and 20 amu, as shown in the graph 22. The graph 24 depicts hypothetic time profiles of parent ions at the exit of the CID cell 15 and graph 25 shows time profiles for the corresponding daughter ions. It is expected that when arranging the appropriate CID cell, e.g. with an axial gas flow or with an axial DC gradient, the transfer time in the CID cell is much smaller compared to the width of profiles 24 and 26, such that the corresponding fragment profiles would be highly correlated in time with parent ion profiles. There is expected substantially at or between a 100-200 us mass dependent delay which could be calibrated experimentally and then accounted at the correlation analysis. The graph 26 depicts triggers of the OA, basically demonstrating that during the parent emission profile there would occur large number of frequent encoded starts. In a finer time scale (not shown), intervals between pulses are designed to be mostly unique, so that mass spectral peaks would not be systematically overlapping and would allow mass spectral decoding. Frequent encoded pulsing substantially (50-100 fold) increases duty cycle of MS-MS analysis and simultaneously allows rapid tracking of time profiles 24 and 25.

An example will now be described. In an implementation, the parent ion mass scan is arranged in a quadrupole mass spectrometer at a total scan time of generally at or about one second. The quadrupole selector is arranged to have mass window of generally at or about 10 amu. Then each individual parent ion mass passes through the quadrupole analyzer for at or about 10 ms. Quadrupoles at low mass resolution have nearly unity ion transmission. The prolonged transmission of parent ions may extend the dynamic range of the tandem analysis thereby yielding an overlapping of multiple parent ions (with different mass to charge ratio). This may be resolved by analyzing the time profiles of individual parent masses, so as by time correlation between parent and fragment ions as described below. Thus, rapid tracking of profiles 24 and 25 allows such arrangement with prolonged time windows for parent transmission (enhancing sensitivity) without loosing resolution of parent ion selection.

In an implementation, for any particular parent ion mass, the time profile after MS1 will have a gate shape with rising and falling edge of at or about 0.5 amu. After passing through the CID cell with typical 1 ms transfer time, the profile edges would swallow. Profiles of different fragment masses are likely to shift within 1 ms time, wherein the time shift is correlated with fragment mass and could be experimentally calibrated. A particular ion family (a collection of parent ions with corresponding fragment ions) would be arriving to the orthogonal accelerator during approximately ~10 ms time, thus enhancing sensitivity compared to conventional MS-MS strategies with shorter 1 ms dwell time. In an implementation, the orthogonal accelerator is pulsed at an average period of 10 us, while being time encoded, which enhances duty cycle (and hence sensitivity) by 50-100 fold compared to standard operation of high resolution MR-TOF, and simultaneously enhances speed of families profile tracking. An exemplar time encoding sequence can be expressed by pulse number (i) and time as $Ti=T_1+T_2*i*(i+1)/2$, where $T_1$=10 us, $T_2$=10 ns and i=0, 1, 2 . . . 100. Such encoding string is repeated for approximately every 1 ms. The data at the MR-TOF detector are acquired in so-called data logging fashion. The signal is stripped from zeros (sparse format) and each non-zero splash of signal is recorded such that to keep an information on the laboratory time (e.g. the number of current pulse string), time-of-flight corresponding to the "splash" start, and sequence of non-zero signal intensities. To separate adjacent splashes, an individual record can be ended by zero intensity. The flux of multiple records corresponding to such multiple flashes may then be analyzed in a multiple core CPU or a GPU. For typical ion fluxes in tandem mass spectrometers at or under 100 million ions a second (160 pA current), the data flow is expected to pass through modern signal busses (say up to 800 Mbyte/sec in 8-lane PCIe) and through GPU processing. It is important that the signal contains the information on laboratory time, such that time profiles could be recovered for any observed m/z specie in MR-TOF spectra.

Since typical flight time in multi-reflecting mass spectrometers (MR-TOF) are in the order of 1 ms, and triggering pulses are 100 times more frequent, the MR-TOF signal becomes strongly overlaid. For recovering m/z information out of encoded spectra there is employed a method of spectral decoding which is based on reconstructing signal series with the knowledge on triggering pulse intervals. An exemplary encoding-decoding method is disclosed in a WO2011135477, incorporated herein by reference in its entirety. In the present numerical example, the duration of parent ion profile is at or about 10 ms, and the average pulse period is at or about 10 us, so the signal sequence would contain up to 1000 of individual ion signals. According to our own studies, the decoding algorithm is expected to recover signal series containing as little as 10 to 20 ions per series. In an implementation, rare overlaps between series can be discarded at a "logical analysis" step after reconstructing individual series. Thus, within the total flux of 1E+8 ions/sec, and at 1E+6 ions admitted during 10 ms profiles, the minimal recoverable signal corresponds to approximately 10 ions. The minimal interpretable tandem mass spectrum is expected to be at or about 100 ions. The overall dynamic range of data independent analysis for all parent masses is estimated as 1E+4 per 1 second analysis. The dynamic range of the overall LC-MS-MS analysis is expected to be approximately 10 fold higher, when accounting 10 fold repetition of MS-MS scanning during typical 10 sec LC peak width.

In an implementation, the decoding step will recover the information on the detected flight times and accurate mass to charge ratios of the fragment ions, and what is also important, of parent ion masses, since typical CID fragmentation is incomplete. Within a collection of momentarily observed peaks, the parent ion mass peaks will be distinguished as those peaks which correspond to the heaviest molecular weight, with the account of charge state, which in turn, is to determined based on isotope spacing. As an example, doubly charged ions would have 0.5 Th spacing, triply charged −0.33 Th spacing. Once mass components are known, parent ion peaks are determined, and there is also retained an information on corresponding individual signal splashes, one can reconstruct their time profiles. Then the correspondence between parent and fragment ions is to be derived upon laboratory time correlation, meaning that corresponding fragments appear simultaneously with parent ions. Though multiple profiles are likely to be partially overlapped, the accuracy of time correlation is expected in the order of 10% of the profile width. In other words the accuracy of time correlation is expected in the order of 1 ms, i.e., corresponding to 1 Th of parent ion mass. Thus, in spite of admitting wider mass window (say 10 Th) accompanied with 10-fold enhancement of signal intensity, the effective resolution of the parent ion determination is 1 Th.

At the effective 1 Th parent mass separation, and due to following LC profiles with the accuracy of at least 10% of chromatographic peak, the overall separation power of the analysis is expected to be in the order of 1E+6, i.e. adequate for proteomics analysis, where 100-300 separation factor comes from LC separation, factor of 10 enhancement comes from accurate following of LC profiles (at 1 second full scan time and typical 10 sec LC peak width), and factor of 1000 comes from parent mass separation. One may further enhance the separation power by interpreting so-called chimera spectra, wherein overlapped fragment spectra still could be interpreted while using the information on accurate masses of fragment ions, expected to be under 1 ppm in high resolution MR-TOF spectrometry.

The described strategy can be optimized in multiple ways. First, the width of the admitted window can be adjusted based on spectral and sample complexity, such that to provide adequate separation while maximizing the duty cycle of the parent separation in MS1. Second, the scanning speed could be optimized based on LC peak width. For example, the method can be applied to rapid separations, like CE. Third, the scanning (ramping) speed may be varied during the scan based on parent mass local population. For example, for peptide ions, the most dense m/z region is between 400 and 600 amu, which is formed by multiply charged peptide ions. Fourth, during the parent mass scan, the fragmentation energy (i.e. energy of ion injection into the CID cell) may be scanned at a much faster rate, such that the energy microscan occurs during a passage of a single parent mass window. Fifth, the average fragmentation energy may be scanned, such that collision energy grows at higher parent m/z. It is also anticipated that the MI scan is accompanied with a ramping of lens voltages so as of radiofrequency voltages of the ion guide, for an optimized transmission of a current m/z range of parent ions. Such voltages may be adjusted in multiple elements in the region from the ion source, through the analytical quadrupole, and all the way to collisional cell.

Figure 3:
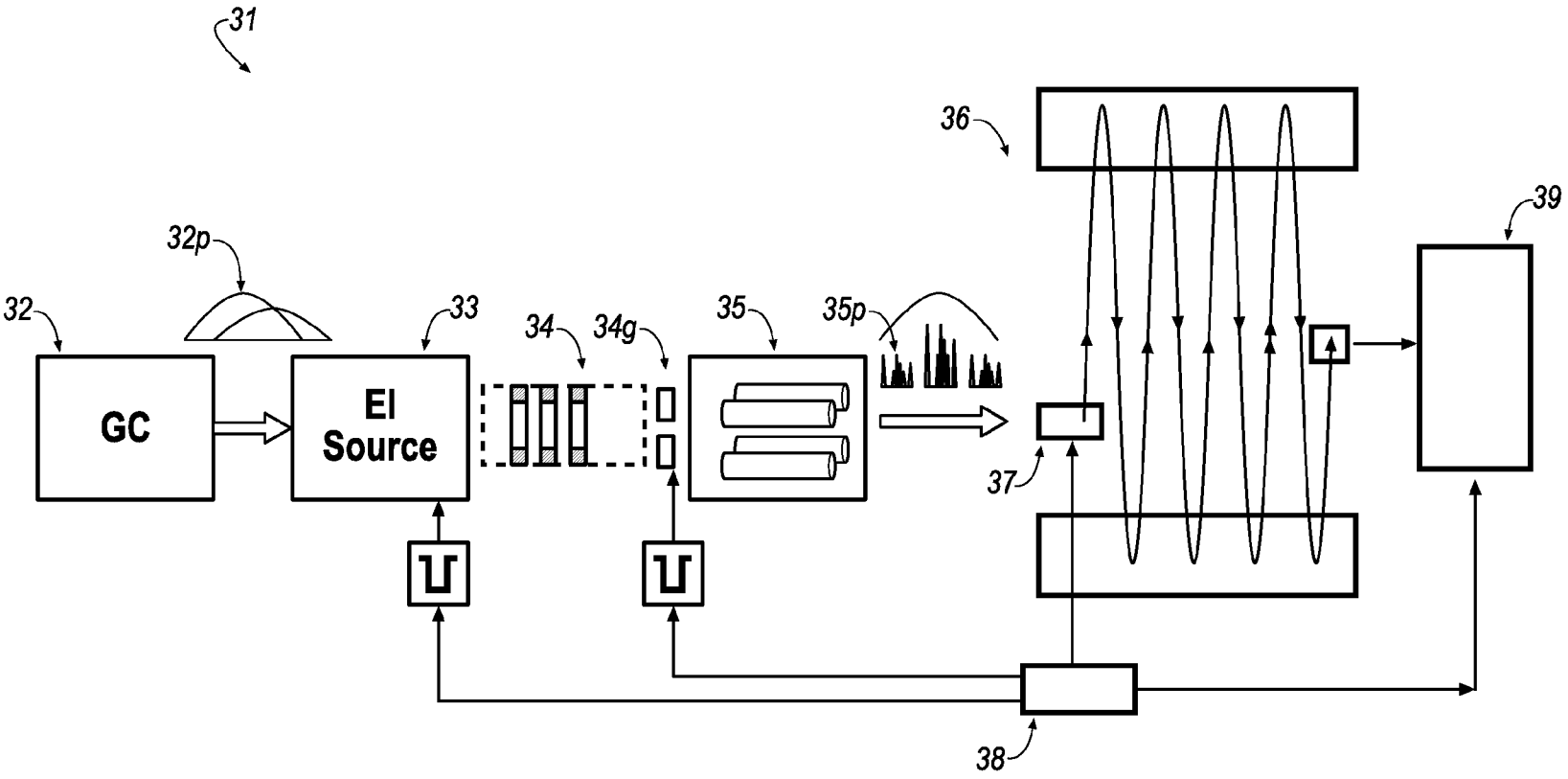
FIG. 3 illustrates an embodiment of a spectrometry apparatus, according to an implementation.

With reference now to FIG. 3, another exemplary apparatus 31 comprises an upfront gas chromatograph 32, an accumulating ion source 33 for ionizing sample, a time-of-flight separator 34, a CID cell 35, a multi-reflecting analyzer 36, with an orthogonal accelerator 37, being driven by a generator 38 with frequent encoded pulses, and a decoding data system 39 fed by ion signal and obtaining an information of triggering pulse timing. The output profiles 32*p* of the chromatograph 32 are expected to be substantially at or about 1 second wide. In an implementation, the ion source 33 is a closed electron impact EI source, capable of storing and pulse ejecting parent ions by applying pulses to a repeller and extraction electrodes as described in WO2012024468. Preferable ion ejection period is chosen about 30 us. In an implementation, the time-of-flight separator 34 is a linear time-of-flight drift region of 10-20 cm long, preferably incorporating electrostatic lens for spatial ion focusing. Parent ion selection is arranged by time gate 34 g at the entrance of CID cell 35. The time gate window is preferably adjusted to scan with approximately 10 Th mass window within a 100 Th mass span, the latter being correlated with the GC retention time (RT). The limited mass span is allowed since parent mass is known to partially correlate with GC retention time. Preferably, the parent mass window is ramped at approximately 1000 Th/s speed to scan 100 Th mass window span in 0.1 sec while momentarily transmitting a relatively wide (substantially at or between 10-20 Th) mass window for selecting parent ions, as shown in diagram 35*p*. In an implementation, parent ions may be injected into CID cell 37 substantially at or between 20-50 eV energy into a collisional cell to induce fragmentation. In an implementation, CID cell 37 is filled with Helium to minimize interference with said EI source 33 and to allow higher range of injection energies for relatively small parent ions of semi-volatile compounds typical for GC separation. Preferably, the CID cell 37 is heated to 200-250 C to avoid surface contamination by semi-volatile analyte. Preferably, the CID cell is equipped with auxiliary electrodes 34*a* to form an axial DC field. Preferably, said auxiliary electrodes 34*a* have double wedge geometry to provide for linear potential distribution, as shown in the figure insert. Axial DC field accelerates ion passage through the CID cell to 300-500 us. Still, short (1.5 us) ion packets entering CID cell 37 with 30 us period are expected to be widened and smoothed in gas collisions to approximately 300 us, thus converting periodic pulses into a quasi-continuous ion flow. As a result, at the output of the CID cell 35 there will appear families of parent and fragment ions correlated at approximately 300 us time scale. Exemplary families are depicted by profiles 35*p*, where sharp peaks generally correspond to an individual family and wider curves generally depict a much slower modulating profile of the chromatographic peak with 1 sec width. In an implementation, the entire ion beam is substantially continuously (being more precise, quasi-continuously) fed into the orthogonal accelerator 37. In an implementation, the accelerator 37 is pulsed at an average rate of substantially at or about 100 kHz (10 us pulse period) in an encoded fashion, wherein the majority of pulse intervals are unique, such that the overlaid spectra could be decoded in the decoder 39.

Figure 4:
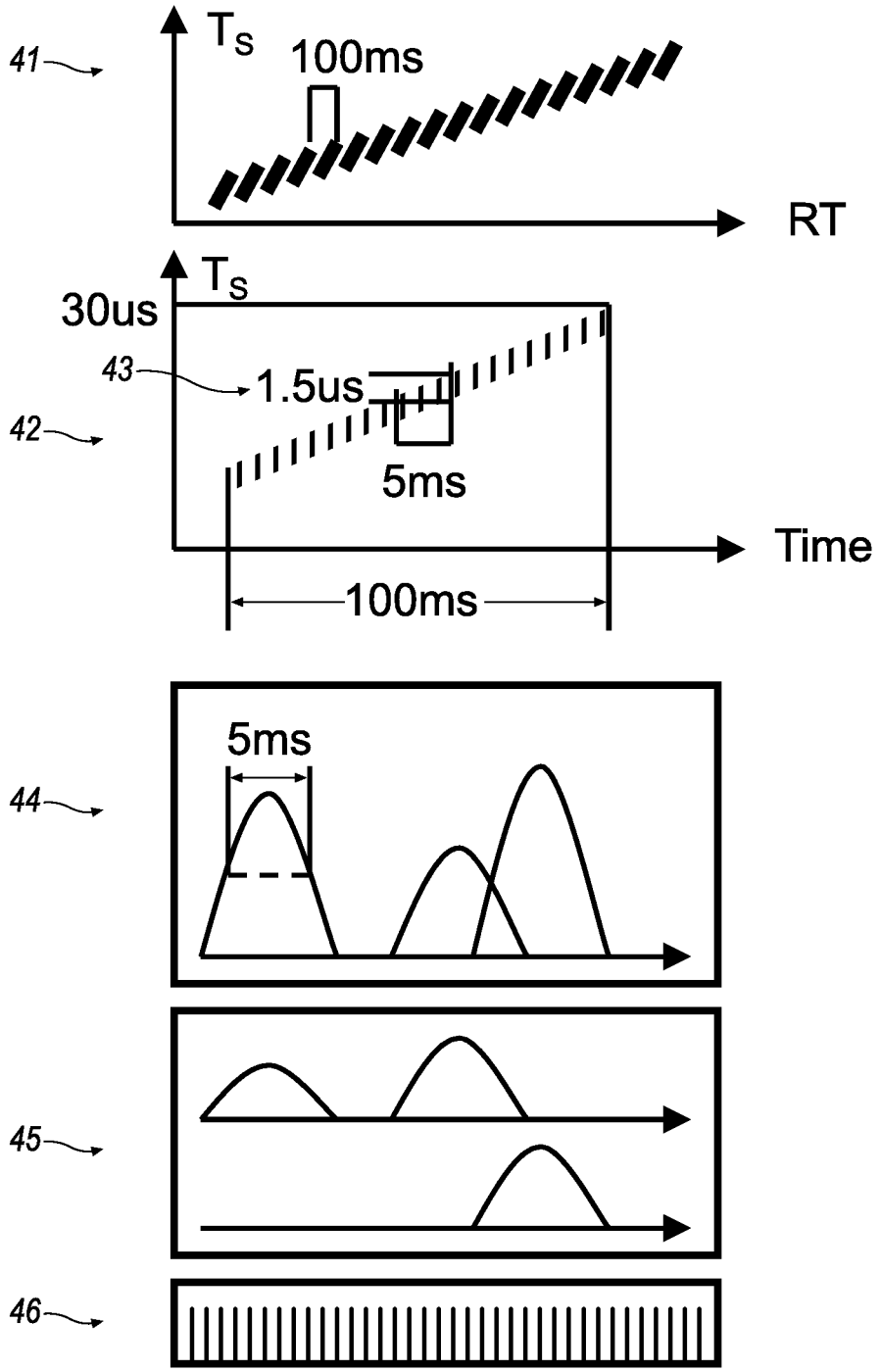
FIG. 4 illustrates a strategy of a ramped data independent analysis.

With reference now to FIG. 4, another exemplar strategy of a ramped data independent analysis is illustrated for apparatus 31 of FIG. 3. The upper graph 41 represents a linear ramp of the gate selector 35 g time at a long time scale corresponding to GC retention time RT (10-30 minutes), accounting a limited span of parent masses per any particular RT. Graph 42 represents a zoom view of the graph 41 at 100 ms time scale corresponding to ramping of parent selection mass. It contains multiple 30 us micro-scans of the time gate 35 g, wherein time is measured relative to periodic pulses of the EI source. Preferably, the admitted time window of the time gate is ramped to transfer the time window 43 corresponding to approximately 10 Th and 1.5 us time windows. Preferably, the time gate span corresponds to 50-100 Th mass span, correlated with GC retention time, this way improving the duty cycle of parent selection to 5-10%. Any particular parent mass is then admitted during approximately 5 ms of the ramping time with time resolution equal to 20 and mass resolution equal to 10. Any particular parent mass is then admitted during 1.5 us pulses, with 30 us period, and during approximately 150 source pulses. Because of time spreading in the CID cell 35, the individual pulses would be smoothed to 5 ms time profiles. The graph 44 depicts hypothetic time profiles of parent ions at the exit of the CID cell 35 and graph 45 shows time profiles for the corresponding daughter ions with characteristic 5 ms peak widths. With an axial DC gradient, the transfer time in the CID cell is much smaller compared to the width of profiles 24 and 26, such that the corresponding fragment profiles would be highly correlated in time with parent ion profiles. There is expected substantially at or between a 200-300 us mass dependent delay which could be calibrated experimentally and then accounted at the correlation analysis. The graph 26 depicts triggers of the OA at the average 10 us period, basically demonstrating that during the parent emission profile there would occur large number of frequent encoded starts of the OA 37. In a finer time scale (not shown), intervals between pulses are designed to be mostly unique, so that mass spectral peaks would not be systematically overlapping and would allow mass spectral decoding. Frequent encoded pulsing substantially (50-100 fold) increases duty cycle of MS-MS analysis. Frequent encoding pulsing of OA also provides rapid tracking of time profiles 44 and 45, this way tracking parent-to-daughter correlation with approximately 1 Th accuracy in spite of admitting wider (10 Th) gates for parent masses and this way further enhancing sensitivity. Summarizing, compared to conventional MS-MS using high resolution MRTOF, the overall expected gain in sensitivity is factor of 1000, wherein factor of 3 comes from correlating parent mass span with RT, factor of 5 to 10 comes from using wide mass windows of 10 Th and factor of 50 to 100 comes from using frequent encoded pulsing of the OA. The limit of detection is expected to be in low femtogram range, dynamic range up to 1E+6, achieved at high specificity of the analysis.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Implementations of the subject matter and the functional operations described in this specification can be implemented in digital electronic circuitry, or in computer software, firmware, or hardware, including the structures disclosed in this specification and their structural equivalents, or in combinations of one or more of them. Moreover, subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The terms "data processing apparatus", "computing device" and "computing processor" encompass all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as an application, program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

One or more aspects of the disclosure can be implemented in a computing system that includes a backend component, e.g., as a data server, or that includes a middleware component, e.g., an application server, or that includes a frontend component, e.g., a client computer having a graphical user interface or a Web browser through which a user can interact with an implementation of the subject matter described in this specification, or any combination of one or more such backend, middleware, or frontend components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specifics, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What I claim is:

1. A system for data independent MS-MS analysis comprising:

an ion source arranged to receive a sample;

an analytical quadrupole analyzer residing proximate the ion source to receive an ionized sample from the ion source, the analytical quadrupole analyzer configured to transmit a parent mass window;

a collisional induced dissociation cell receiving parent ions to induce fragmentation; and a multi-reflecting analyzer comprising:

two parallel ion mirrors;

an orthogonal accelerator; and a decoding data system, wherein the orthogonal accelerator receives families of parent and fragment ions from the collisional induced dissociation cell and accelerates the ions onto a path for reflecting between the two parallel ion mirrors; and wherein the decoding data system is operable to decode encoded signal strings corresponding to the parent mass window in order to form fragment spectra based on a time correlation between fragment and parent masses, and wherein the system for data independent MS-MS analysis is operable to adjust a scanning time in a step of parent mass selection based on a chromatographic peak width.

2. The system as in claim 1, further comprising an upfront gas chromatograph.

3. The system as in claim 1, further comprising an upfront liquid chromatograph.

4. The system as in claim 1, wherein the orthogonal accelerator is operable to pulse a string of time-encoded pulses.

5. The system as in claim 4, wherein the orthogonal accelerator is operable to pulse at an average rate between 90 kHz and 110 kHz in an encoded fashion.

6. The system as in claim 1, wherein the collisional induced dissociation cell is operable to substantially continuously feed an ion beam into the orthogonal accelerator.

7. The system as in claim 1, wherein the analytical quadrupole analyzer is operable to receive a ramped or stepped parent mass window having a width of at least 10 amu.

8. The system as in claim 1, wherein the collisional induced dissociation cell accomplishes rapid ion transfer by at least one of: axial gas flow, an axial DC field, and a travelling RF wave.

9. A method of data independent MS-MS analysis comprising the following steps:

ramping or stepping in small steps of a parent mass window in a first parent selecting mass spectrometer (MS1), the parent mass window having a width of at least 10 amu;

arranging rapid ion transfer through a collisional cell, either by axial gas flow or by an axial DC field or by a travelling RF wave;

frequently pulsing an orthogonal accelerator with a string of time-encoded pulses;

analyzing fragment ions in a multi-reflecting time-of-flight mass spectrometer;

acquiring data in a data logging format;

decoding signal strings corresponding to the parent mass window, such that fragment spectra are formed based on time correlation between fragment and parent masses; and adjusting a scanning time in a step of parent mass selection based on a chromatographic peak width.

10. A method as in claim 9, wherein an average fragmentation energy is scanned such that a collision energy increases for higher parent masses.

11. A method as in claim 9, further comprising an upfront chromatographic separation in one of a gas chromatograph and a liquid chromatograph, wherein scanning time in a step of parent mass selection is adjusted to be at least three times faster than chromatographic peak width, and wherein a mass span in said step of parent mass selection is adjusted according to an expected mass span correlating with chromatographic retention time.

12. A method as in claim 9, wherein a step of parent mass selection comprises parent selection in quadrupolar mass spectrometer or in a time-of-flight mass spectrometer following pulsed release of ion packets from an ion source.

* * * * *